US005473867A

United States Patent [19]

Suga

[11] Patent Number: 5,473,867

[45] Date of Patent: Dec. 12, 1995

[54] APPARATUS FOR PACKAGING ARTICLES IN DEAERATED CONDITION

[75] Inventor: Yasutaka Suga, Ibaraki, Japan

[73] Assignee: Ibaraki Seiki Machinery Company, Ltd., Osaka, Japan

[21] Appl. No.: 378,051

[22] Filed: Jan. 25, 1995

Related U.S. Application Data

[62] Division of Ser. No. 160,610, Nov. 30, 1993, abandoned.

[30] Foreign Application Priority Data

Dec. 24, 1992 [JP] Japan ..... 4-359555
Feb. 17, 1993 [JP] Japan ..... 5-053020

[51] Int. Cl.[6] ..... B65B 31/04

[52] U.S. Cl. ..... 53/511; 53/550

[58] Field of Search ..... 53/56, 57, 75, 53/511, 512, 433, 434, 450, 550

[56] References Cited

U.S. PATENT DOCUMENTS

| | | | |
|---|---|---|---|
| 2,145,941 | 2/1939 | Maxfield | 53/511 |
| 3,113,409 | 12/1963 | Thurlings | 53/511 |
| 3,150,472 | 9/1964 | Moore | 53/512 |
| 3,274,746 | 9/1966 | James | 53/511 |
| 4,170,863 | 10/1979 | Schwanz | 53/511 |
| 4,241,563 | 12/1980 | Muller | 53/511 |
| 4,964,259 | 10/1990 | Ylvisaker | 53/433 |
| 5,311,726 | 5/1994 | Rauscher | 53/511 |

FOREIGN PATENT DOCUMENTS

| | | | |
|---|---|---|---|
| 1511628 | 8/1969 | Germany . | |
| 795397 | 5/1958 | United Kingdom | 53/433 |
| 988343 | 11/1963 | United Kingdom . | |
| 2250499 | 6/1992 | United Kingdom . | |

*Primary Examiner*—Daniel C. Crane
*Attorney, Agent, or Firm*—Barnes, Kisselle, Raisch, Choate, Whittemore & Hulbert

[57] ABSTRACT

An apparatus for packaging articles in deaerated condition. A belt-like film is tubulated to enclose a plurality of articles transported in a longitudinally aligned fashion. The articles and the film are transported together in integral relation while the air in the tubular film is evacuated by a pipe nozzle inserted in the film tube. The pipe nozzle is connected to a vacuum source via a connecting pipe. Usually, the interior of the tubular film is kept in a suitable negative pressure condition by suction through a tube bypassing a normally closed valve disposed on the connecting pipe. The valve is impulsively opened immediately before seal bars press the film from opposite sides so that the air in the film is instantly discharged.

8 Claims, 9 Drawing Sheets

APPARATUS FOR PACKAGING ARTICLES IN DEAERATED CONDITION

This is a divisional of application Ser. No. 08/160,610 filed on Nov. 30, 1993, now abandoned.

FIELD OF THE INVENTION

The present invention relates to a method and apparatus for packaging articles in deaerated condition. More particularly, the invention relates to a packaging method in which a longitudinally running belt-like film is tubulated sequentially about a multiplicity of articles transported in a longitudinally aligned fashion, the air in the tubulated film being sucked by and into a vacuum tube inserted in the tubulated film so that deaeration is effected around respective articles, followed by sealing, and an apparatus therefor.

BACKGROUND OF THE INVENTION

An apparatus for packaging articles in deaerated condition is known as disclosed in Japanese Utility Model Application Laid-Open No. 2-43207. This apparatus has an elongate pipe nozzle disposed along a transport path for transporting a multiplicity of articles in a longitudinally aligned condition and connected at one end to a vacuum pump. A belt-like film is tubulated to enclose articles and the pipe nozzle integrally therewith, the tubulated film being then heat sealed between adjacent articles as the air in the tubulated film is sucked by the pipe nozzle.

With this known packaging apparatus, the trouble is that when the air in the tubulated film is a little too vigorously sucked by the nozzle, there will develop a pressure differential relative to the exterior that will cause the film to cling to the pipe nozzle. This causes friction between the nozzle and the film, which will prevent the film and individual articles from advancing further. Therefore, with such a prior art apparatus for packaging articles in deaerated condition, it is necessary that the degree of vacuum be lowered in proportion as the film travels farther, which makes it impracticable to achieve any satisfactory deaeration.

DISCLOSURE OF THE INVENTION

In view of the above noted fact, it is an object of the present invention to provide a method and apparatus for packaging articles in deaerated condition which provide a higher degree of vacuum.

In order to accomplish this object, according to the present invention there is provided a method of packaging articles in deaerated condition wherein a plurality of articles to be packaged are transported in a longitudinally aligned condition; wherein a belt-like film moving in the same direction as the articles is tubulated in such a way as to sequentially enclose the articles and an elongate pipe nozzle disposed along a path for transport of the articles, the pipe nozzle being connected to a source of vacuum via a connecting pipe; and wherein the tubulated film is pressed by seal bars from opposite sides at a location adjacent one end of the pipe nozzle while the air in the tubulated film is sucked by the pipe nozzle, so that the tubulated film is cyclically cross sealed between adjacent articles, said method comprising:

keeping the interior of the film in a negative pressure condition through sucking action of the pipe nozzle so as not to cause any greater friction than necessary between the pipe nozzle and the film, when the articles being packaged are transported in conjunction with the movement of the film; and causing the pipe nozzle to produce an impulsive suction force in cyclically timed relation to cross sealing action of the seal bars on the film but immediately prior to the film being pressed by the seal bars from opposite sides, thereby enabling the air in the interior of the film to be momentarily discharged.

Also, according to the present invention, there is provided an apparatus for packaging articles in deaerated condition which includes an elongate pipe nozzle disposed along a path for transport of the articles to be packaged, means for tubulating a belt-like film moving in the same direction as the articles in such a way as to sequentially enclose the articles and the pipe nozzle, the pipe nozzle being connected to a source of vacuum via a connecting pipe, and seal bars for cross sealing the tubulated film cyclically by pressing the film from opposite sides and between adjacent articles at a location adjacent one end of the pipe nozzle while the air in the tubulated film is sucked by the pipe nozzle, said apparatus comprising:

the connecting pipe, which connects the pipe nozzle to the vacuum source, having a cross-sectional passage area comparable to or larger than that of the pipe nozzle;

a first on-off valve of the normally closed type provided midway on the connecting pipe;

a bypass tube bypassing the first on-off valve and having a cross-sectional passage area smaller than that of the pipe nozzle; and control means for impulsively opening the on-off valve in cyclically timed relation to the cross sealing action of the seal bars but immediately prior to the film being pressed by the seal bars from opposite sides.

In such method and apparatus, the first on-off valve disposed midway on the connecting pipe which connects the pipe nozzle to the vacuum source is of the normally closed type and, therefore, usually the air in the tubulated film is normally sucked through the bypass tube which bypasses the on-off valve. In this case, the cross-sectional passage area of the bypass tube is smaller than that of the pipe nozzle disposed on the tubulated film, and air flows successively into the tubulated film through the film and articles under transport. Therefore, it is unlikely that there will develop any large friction between the pipe nozzle and the film which may produce such pressure differential as may inhibit film movement. In other words, the bypass tube operates to discharge at least fresh inflow of air thereby to keep the interior of the tubulated film in negative pressure condition. And immediately before the seal bars press the tubulated film from opposite sides, the first on-off valve is impulsively opened so that the air in the film is sucked and discharged through the larger-bore connecting pipe.

According to one preferred embodiment of the invention, when there occurs any unusual spread in pitch data corresponding to feed intervals of articles on the transport path, a second on-off valve of the normally open type disposed downstream of the first on-off valve is closed, whereby the movement of the film and seal bars is halted. When the film and seal bars which have been at a halt begin to resume operation, a larger time lag is set between timing for film cross sealing by the seal bars and timing for the second on-off valve being opened to enable the pipe nozzle to start vacuum suction that precedes the timing for cross sealing.

This makes it possible to gain time for discharge of air that has entered the tubulated film during the stop of film movement. Therefore, when operation is resumed after there having been some short feed of articles, for example, any trouble such that a first package made is insufficiently vacuumed can be effectively prevented.

According to another preferred embodiment of the invention, when movement of film and seal bars is resumed after an operation stop, the film and seal bars are caused to restart movement first at a gentle speed and later at some accelerated speed. In this case, too, time is gained for discharge of air that has entered the tubulated film during a period of film movement stop.

DESCRIPTION OF THE PREFERRED EMBODIMENTS

Figure 3:
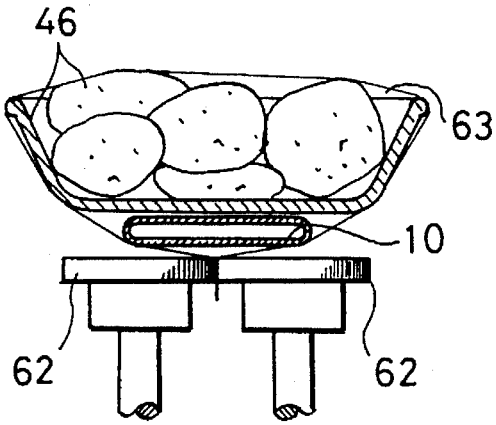
FIG. 3 is a section taken along the line III—III in FIG. 1.
Figure 4:
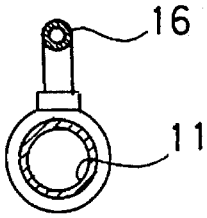
FIG. 4 is a section taken along the line IV—IV in FIG. 1.
Figure 5:
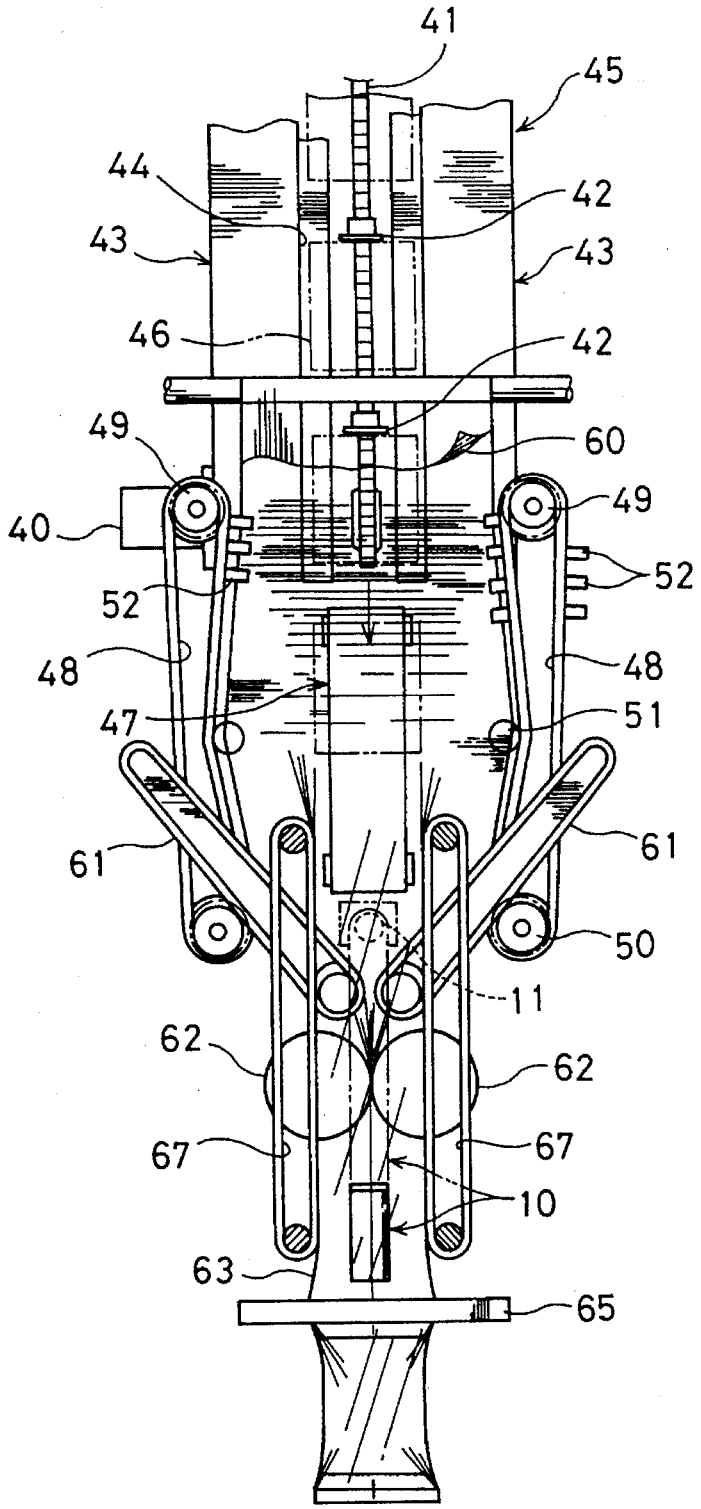
FIG. 5 is a general view in plan showing the packaging apparatus of the invention.

A preferred embodiment of the invention is shown in FIGS. 1 to 7. As FIG. 5 shows, a feed conveyor 45 includes an endless chain 41 powered by a motor 40 to run at a constant speed on which are supported a multiplicity of attachments 42 in equispaced relation. A pair of frames 43 are disposed on both sides of the chain 41, with a groove 44 formed between top surfaces of the frames 43. The feed conveyor is adapted to slide an article 46 as pushed by each attachment 42, within the groove 44 for transfer onto a conveyor 47 located therebehind as shown by the arrow.

Figure 6:
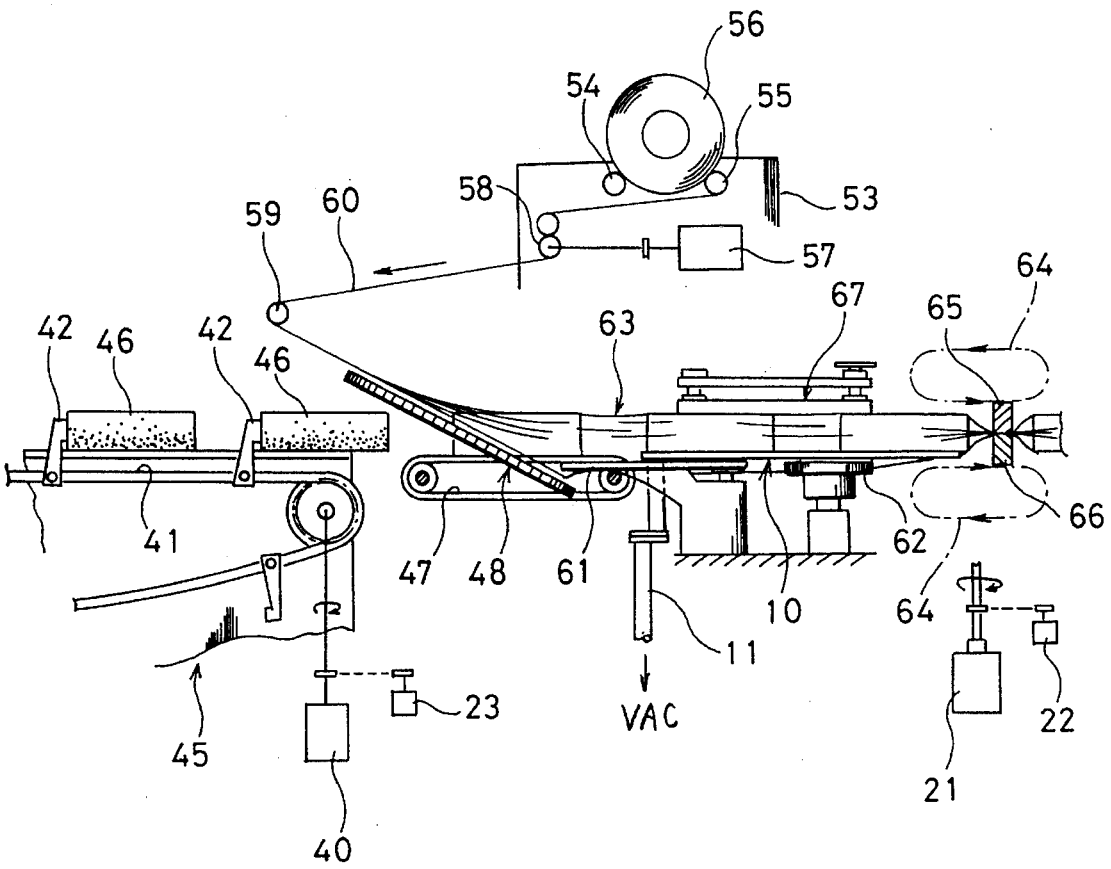
FIG. 6 is a side view of the packaging apparatus shown in FIG. 5.

On both sides of the conveyor are provided a pair of side chains 48 which are each trained around two chain wheels 49, 50 and a tension wheel 51. As FIG. 6 shows, the chains 48 are so arranged as to become downwardly inclined in the direction of transport of articles and respectively have a multiplicity of clampers 52 arranged thereon in equispaced relation. The clampers 52 are similar in construction to a known paper clip and are normally allowed to retain their clamping force by a spring force, but only while they are in contact with circular cams (not shown) provided on the shafts of the two chain wheels 49, 50, the clampers are opened so that they are relieved of their clamping force in order to catch the side edge of the film which is to be described hereinafter.

As FIG. 6 shows, a roll-form film 56 is placed on two rod-like rollers 52, 55 mounted rotatably on a machine frame 53. As the film is conducted by a roll 58, powered for rotation by the motor 57, into the space between the two chaines 48 via a direction changing roll 59, the belt-like film 60 is obliquely downwardly transported under the rotation force of the chains 48 while being supported at opposite sides thereof by clampers 52. Tension rolls 51 are disposed midway on the chains 48 so that the spacing between the pair of chains 48 is locally enlarged at that location; therefore, the film 60 is, in effect, placed over each article 46 on the conveyor in such a condition that it is tensioned both sideways.

Opposite side edges of the film 60 as released from clampers at the rear chain wheels 50 are drawn together toward a center line through the run of a pair of cord-like belts 61 arranged in a V-shaped fashion, being placed one over the other for being welded together in overlapping relation under a clamping force of a pair of heating rolls 62. As a result, a large number of articles are enclosed in equispaced relation within a tubular film 63. A pair of seal bars 65, 66 travelling along an elliptic trajectory 64 as shown by arrow operate to weld the tubular film 63 between adjacent articles which are transported while being aided by side belts 67 for movement on their path of transport.

In reality, such a packaging apparatus as described above is not particularly new and is taught in, for example, Japanese Patent Application Laid-Open Publication No. 60-183370.

As may be seen from FIGS. 5 and 6, a pipe nozzle 10 is disposed within the tubular film 63 in such a way that its distal end is open adjacent the seal bar 65. A connecting pipe 11 is connected to the pipe nozzle 10 at an underside open portion thereof adjacent front portions of the pair of cord-like belts 61 arranged in V-shape fashion. As FIG. 3 shows, the pipe nozzle 10 is configured to be laterally flat, being of such a construction as to permit individual articles 46 to slide over the pipe nozzle 10 without any surplus space being produced within the tubular film 63.

Figure 1:
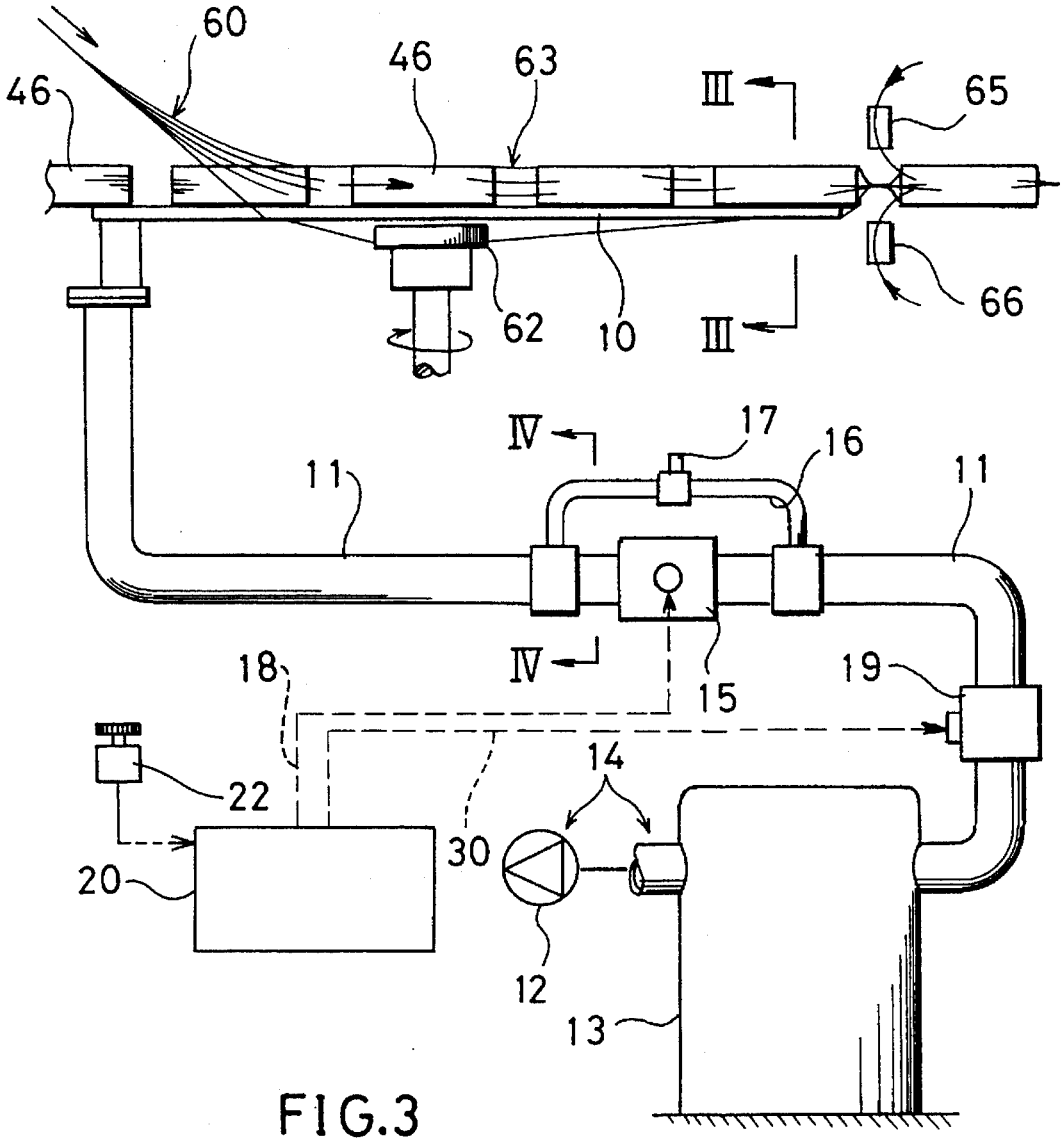
FIG. 1 is a side view showing principal portions of an apparatus for packaging articles in deaerated condition according to one embodyment of the present invention.

As FIG. 1 shows, a vacuum source 14 comprising a vacuum pump 12 and an ancillary tank 13 of a predetermined capacity is connected to the distal end of the connecting pipe 11. The connecting pipe 11 is provided with a normally-closed type electromagnetic on-off valve 15 in parallel with which a bypass tube 16 is connected to the connecting pipe 11. The bypass tube is provided with a flow control valve 17. As FIG. 4 shows, the connecting pipe 11 has a sectional passage area which is about three times as large as that of the pipe nozzle 10 shown in FIG. 3. The sectional passage area of the bypass tube 16 is substantially smaller than that of the pipe nozzle 10.

As operation of the packaging apparatus is stopped, a valve 19 is closed in response to a signal from a controller 20. Then, the degree of vacuum in the ancillary tank 13 rises as the sucking action of the vacuum pump 12 is still continued. When the valve 19 is opened upon start of operation of the packaging apparatus, a flow of air develops under a differential pressure within the connecting pipe 11 toward the ancillary tank 13. Normally, air flows in the bypass tube 16 at a flow rate regulated by a flow control valve 17, and the pipe nozzle 10 sucks thereinto the air within the film. The amount of air in the tubular film changes according to the size of the article being packaged, and the flow control valve 17 is operated accordingly. Movement of the film causes fresh air to flow successively into the tubular film, but the incoming air is sucked into the pipe nozzle 10 so that the interior of the tubular film is held under negative pressure in such a way that the friction between the pipe nozzle and the film is kept from becoming greater than necessary.

Figure 7:
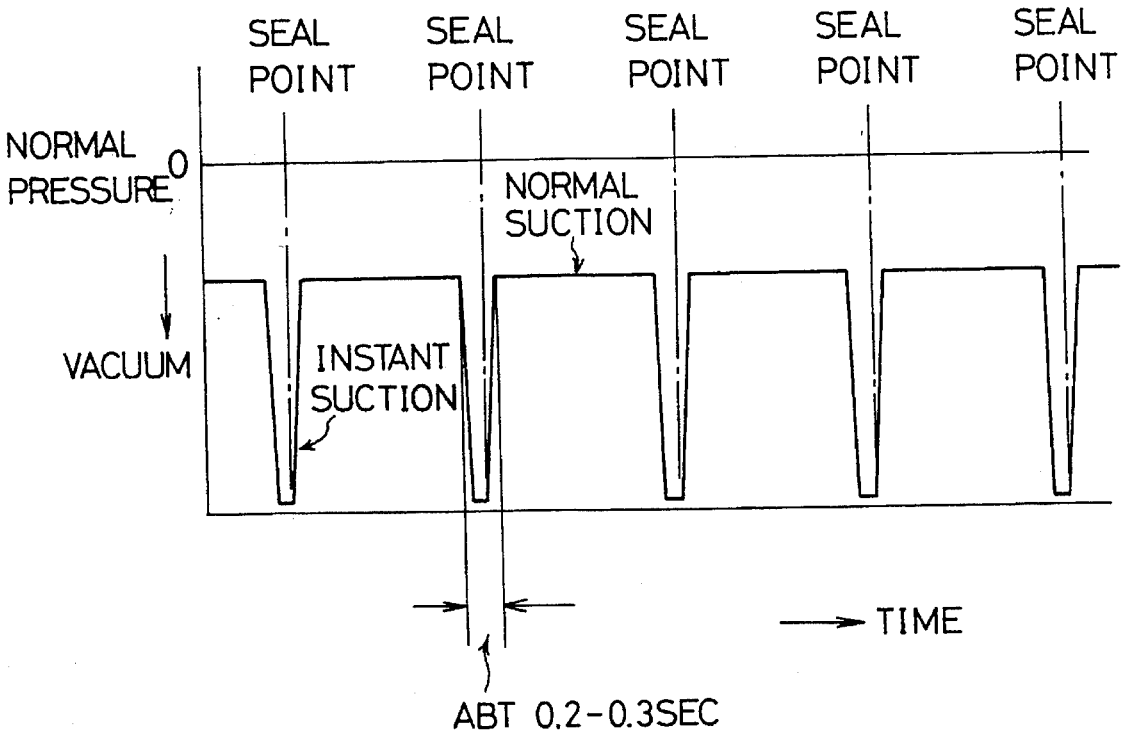
FIG. 7 is a diagram showing the relationship between seal timing and vacuum applied.

The pair of seal bars 65, 66 press the tubular film from opposite sides so as to cross seal the film and, immediately before the seal bars 65, 66 move toward each other to press-hold the tubular film therebetween, the electromagnetic on-off valve 15 is opened for about 0.2 second upon a signal 18 from the controller 20. While the valve is so open, an impulsive suction force acts on the pipe nozzle 10 under a vacuum energy accumulated in the ancillary tank 13, so that the air in the film is momentarily evacuated from a clearance between the pair of seal bars 65, 66. Immediately thereafter, the seal bars 65, 66 press and seal that film portion. FIG. 7 shows that inpulsive vacuum suction is effected immediately prior to the sealing action of the seal bars on the film.

As may be seen from FIG. 6, an encoder 22 is mounted to a motor 21 which drives the pair of seal bars 65, 66 to move along the elliptic trajectory 64, the encoder 22 serving the purposes of detecting the rotation angle of the shaft of the motor and of determining the timing for the pair of seal bars 65, 66 contacting each other on a predetermined cycle. This encoder 22 and an encoder 23 connected to the motor 40 for driving the feed conveyor 45 rotate in proportional relation with each other. Therefore, by connecting one of the encoders to the controller 20 shown in FIG. 1 it is possible to control the electromagnetic on-off valve 15 in corresponding relation to the operation timing for the seal bars.

Figure 2:
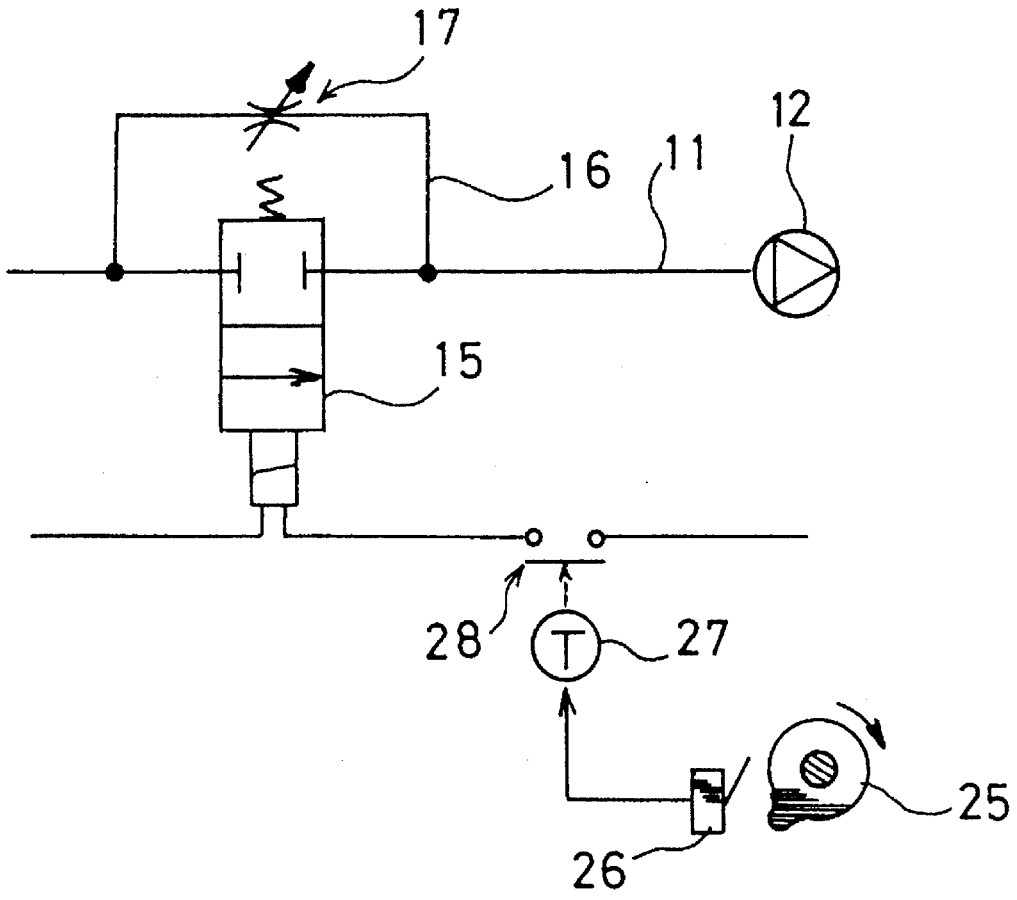
FIG. 2 is a view showing a modification of portions shown in FIG. 1.

In FIG. 2, in place of such an encoder, a rotary cam 25 and a microswitch 20 are used to constitute a rotation angle detector. In particular, each time when a switch 26 is closed by a cam 25 which is rotated by a motor 21 which drives seal bars 65, 66, a timer 27 closes a switch 28 for about 0.2 second, and meanwhile the electromagnetic on-off valve 15 of the connecting pipe 11 is opened.

In this way, air flowing successively into the tubular film 63 is eliminated by a bypass tube 16 having a smaller sectional passage area, so that a negative pressure is kept within the tubular film 63 in such a way that the friction between the tubular film 63 and the pipe nozzle 10 inserted therein may be kept from becoming greater than necessary. Further, immediately before sealing is effected, the connecting pipe 11 which has a greater sectional area of passage is opened to momentarily eliminate air from the tubular film. Therefore, it is possible to package articles under high vacuum with little or no stop of film run due to any friction between the pipe nozzle and the tubular film.

FIGS. 8 to 11 illustrate another embodiment of the invention.

Figure 8:
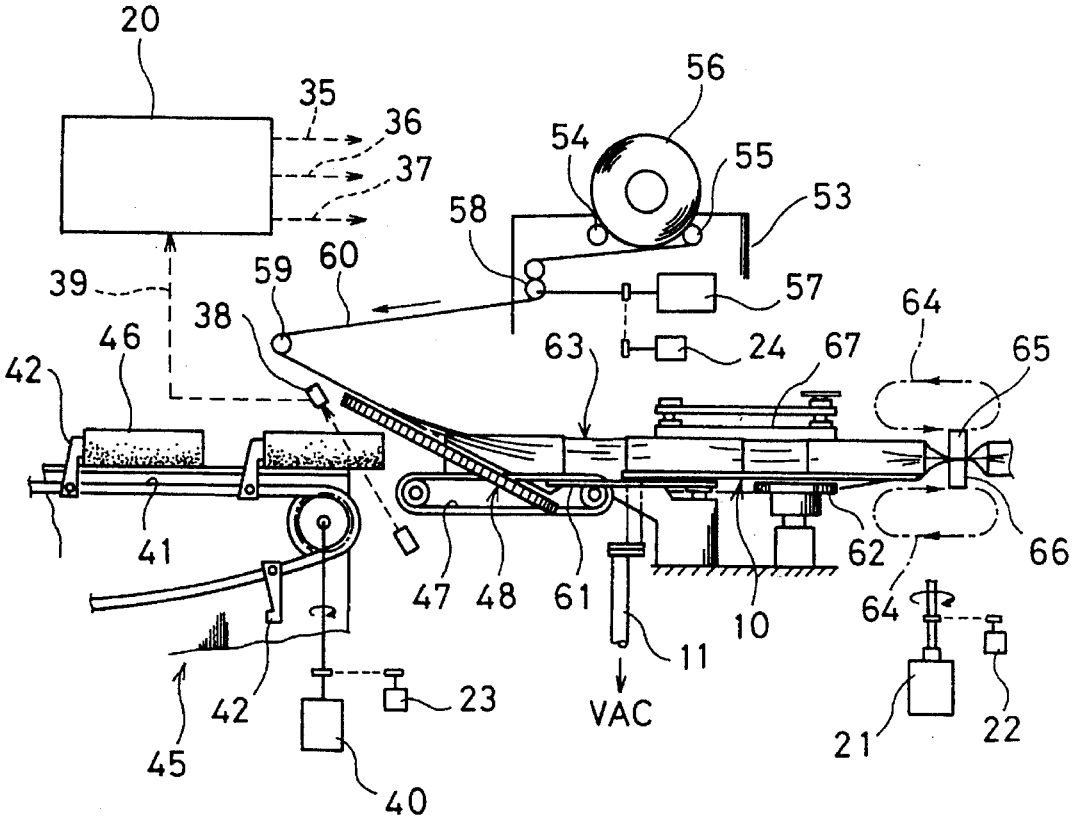
FIG. 8 is a side view showing principal portions of an apparatus for packaging articles in deaerated condition according to another embodiment of the invention.
Figure 9:
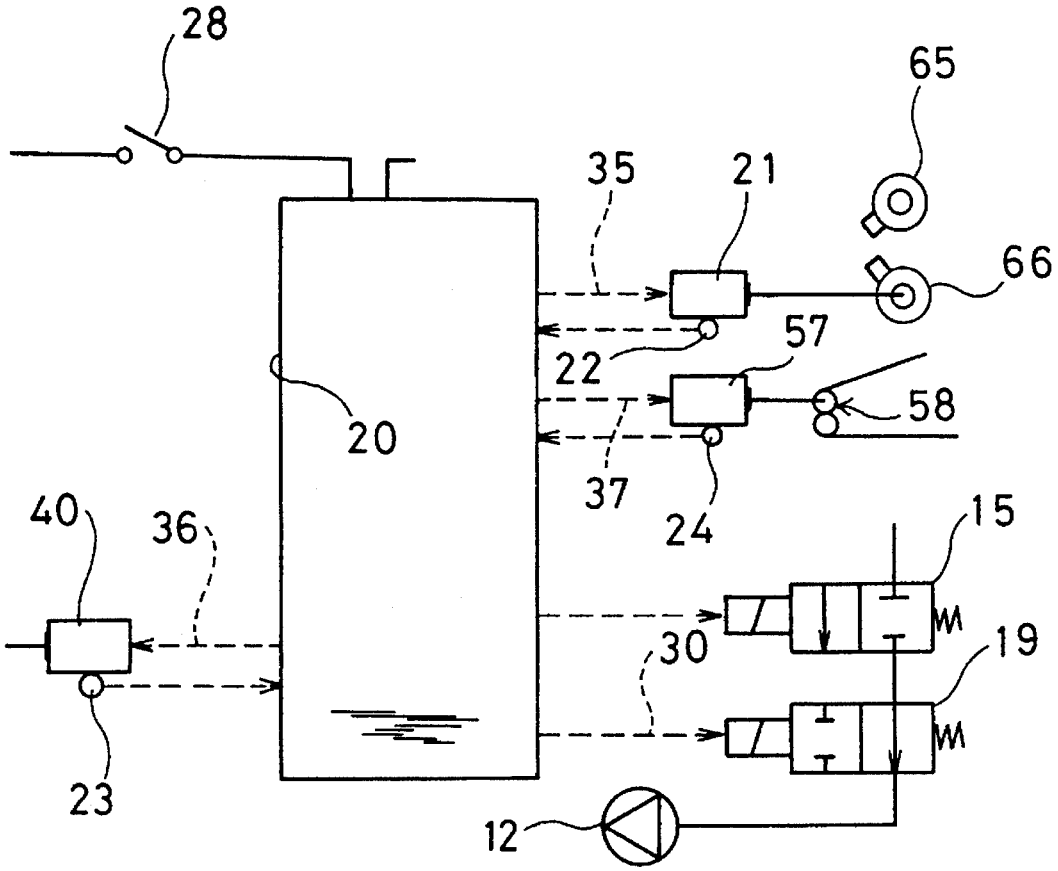
FIG. 9 is a detail view showing a controller and peripheral associated units in the apparatus of FIG. 8.
Figure 10:
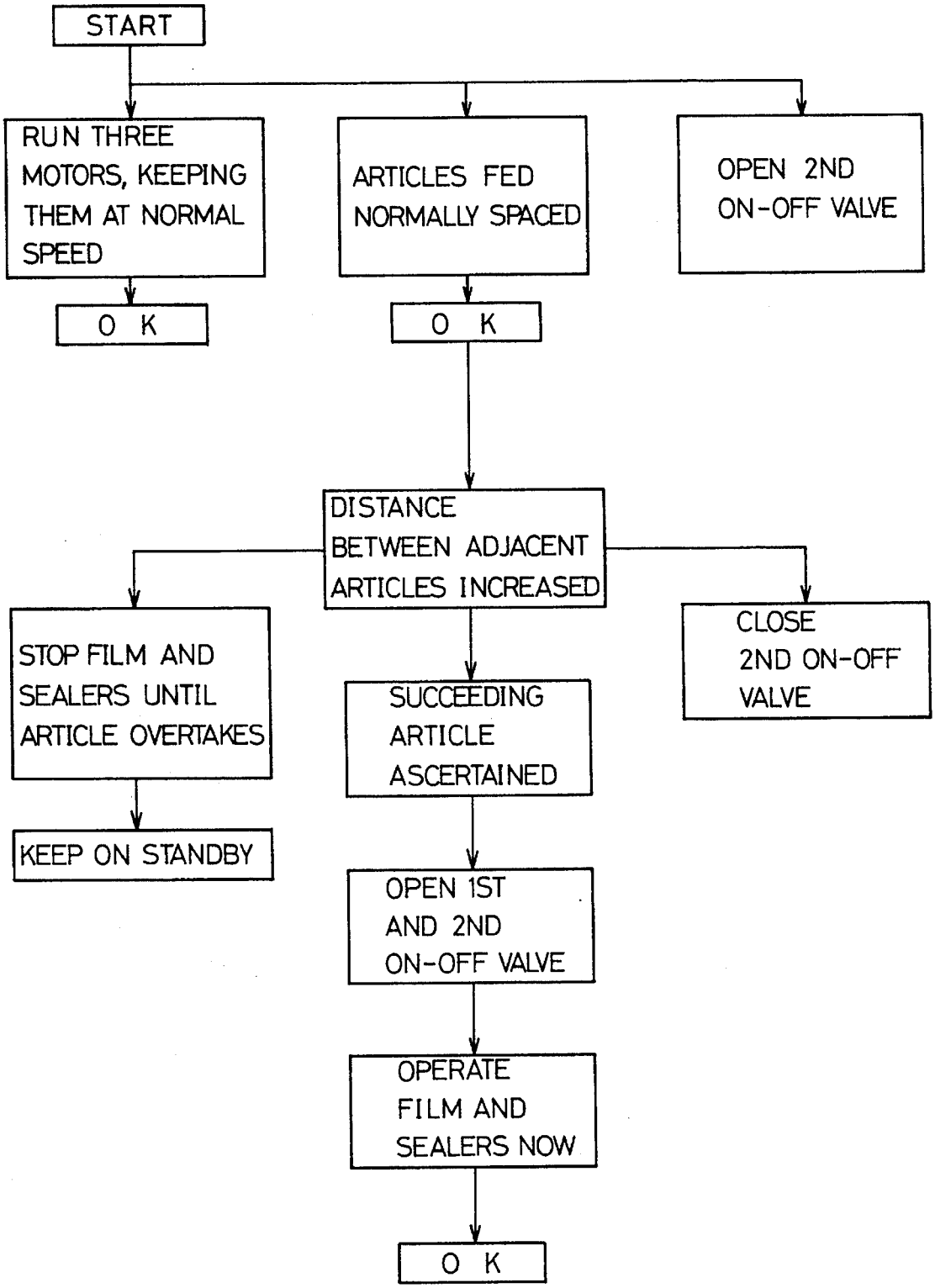
FIG. 10 is a flow chart illustrating one example of operation of the FIG. 8 apparatus.

In FIG. 8, a motor 21 for driving seal bars 65, 66, a motor 40 for driving a feed conveyor 45, and a motor 57 for film transport are respectively provided with encoders 22, 23 and 24 for converting the number of revolution data on the motors into pulse signals. In response to pulse signals fed back from the encoders to a controller 20, the controller 20 issues command signals 35, 36, 37 to the three motors 21, 40, 57 respectively, so that the motors 21, 40, 57 are always kept in their normal running speeds.

A photoelectric switch 38 provided in a transit zone for articles 46 on the feed conveyor 45 is operative to send pitch data signals 39 successively for entry into the controller 20, each pitch data signal 39 corresponding to the spacing between adjacent articles 46 passing a zone under the switch. In the process of such signalling, if articles 46 under transport lack one of them, for example, so that the spacing between adjacent articles is increased, two motors 21 and 57 are caused to stop running at abnormality signals 35, 36 from the controller 20, and accordingly movement of film 60, as well as operation of seal bars 65, 66, is stopped until the conveyor 45 has made up for such disorder so that a succeeding article overtakes the preceding article.

As earlier stated, there is always a flow of air in the bypass tube 16; therefore, when film movement is stopped, the interior of the tubular film becomes excessively vacuum. As such, when operation is restarted, considerable friction develops between the pipe nozzle 10 and the film, so that the film is prevented from advancing.

Therefore, it is arranged that simultaneously upon the film and seal bars 65, 66 being brought to a halt, a second electromagnetic on-off valve 19 is closed at a signal 30 from the controller 20, as shown in FIG. 1. Upon the closure of the valve 19, air naturally flows into the tubular film 63; but the controller 20 releases the first and second electromagnetic valves 15, 19 somewhat earlier than usual. As a consequence, the air in the tubular film is sucked out instantaneously, so that cross sealing can be performed by the seal bars 65, 66 which have resumed their operation, with any redundant air eliminated. The above described process of operation is shown by a flow chart in FIG. 10.

Figure 11:
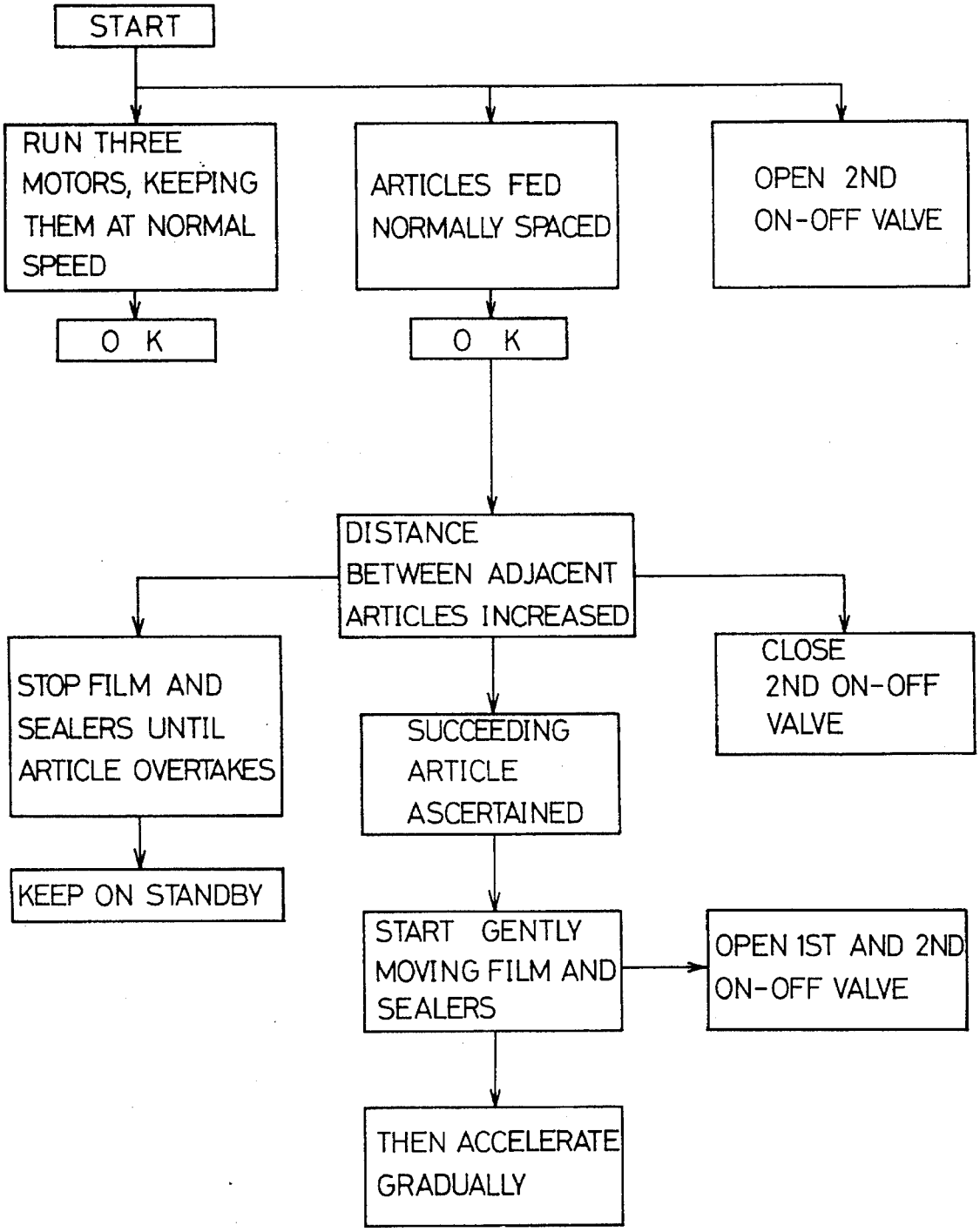
FIG. 11 is a flow chart illustrating another example of operation of the FIG. 8 apparatus.

Instead of the above discussed manner of operation in which the on-off valves 15, 19 are released somewhat earlier than the film and seal bars 65, 66 are driven for movement again, for the purpose of restarting the tubular film 63 and seal bars 65, 66, the film 63 and seal bars 65, 66 may be so controlled that they go into movement initially at a gradual speed and then at an accelerated speed. That is, the film 63, once brought to a halt, is allowed to restart movement at a slow speed, whereby it is possible to make time for discharge of the air present therein. Subsequently, movement is accelerated for making up for any delay involved. A flow chart for this mode of operation is shown in FIG. 11.

In this way, the on-off valves 15, 19 are released slightly earlier than usual, or the tubular film 63, brought to a halt, is allowed to restart movement at a rather slow speed, which makes it possible to make time for discharge of the air which has flowed into the tubular film 63 while at a halt. Therefore, when operation is resumed after a short supply of articles being found, for example, it is possible to prevent a first bag of article from being of insufficient vacuum.

What is claimed is:

1. An apparatus for packaging articles in deaerated condition which includes an elongate pipe nozzle disposed along a path for transport of the articles to be packaged, means for tubulating a belt-like film moving in the same direction as the articles in such a way as to sequentially enclose the articles and the pipe nozzle, the pipe nozzle being connected to a source of vacuum via a connecting pipe, and seal bars for cross sealing the tubulated film cyclically by pressing the film from opposite sides and between adjacent articles at a location adjacent one end of the pipe nozzle while the air in the tubulated film is sucked by the pipe nozzle, said apparatus comprising:

the connecting pipe, which connects the pipe nozzle to the vacuum source, having a cross-sectional passage area comparable to or larger than that of the pipe nozzle;

a first on-off valve of the normally closed type provided midway on the connecting pipe;

a bypass tube bypassing the first on-off valve and having a cross-sectional passage area smaller than that of the pipe nozzle; and control means for impulsively opening the on-off valve in cyclically timed relation to the cross sealing action of the seal bars but immediately prior to the film being pressed by the seal bars from opposite sides.

2. A packaging apparatus as set forth in claim 1, wherein the vacuum source to which the pipe nozzle is connected comprises an ancillary tank capable of holding a sufficient volume of vacuum therein, and a vacuum pump for applying vacuum to the interior of the ancillary tank.

3. A packaging apparatus as set forth in claim 1, wherein the bypass tube bypassing the first on-off valve is provided with a flow control valve capable of regulating the flow of air within the bypass tube.

4. A packaging apparatus as set forth in claim 1, further comprising a rotary shaft for cyclically operating the seal bars, and a rotation angle detector connected to the rotary shaft, and wherein the control means actuates the first on-off valve to perform on-off operation on the basis of signals received from the rotation angle detector.

5. A packaging apparatus as set forth in claim 1, further comprising a conveyor for transporting a plurality of articles to be packaged in a longitudinally aligned fashion toward the film tubulating means, a rotary shaft for driving the conveyor, and a rotation angle detector connected to the rotary shaft, and wherein the control means actuates the first on-off valve to perform on-off operation on the basis of signals received from the rotation angle detector.

6. A packaging apparatus as set forth in claim 1, further comprising:

means for detecting feed intervals with respect to articles to be packaged on the transport path for the articles thereby to obtain pitch data corresponding to the feed intervals;

means for stopping the film and seal bars when an unusual spread occurs with respect to the pitch data and until the unusual spread is eliminated;

a second on-off valve of the normally open type disposed downstream of the first on-off valve on the connecting pipe and oriented in the direction of vacuum suction by the pipe nozzle;

means for closing the second on-off valve while movement of the film and seal bars is at a stop; and means for controlling, when the film and seal bars, at a halt, resume their movement, the timing for film cross sealing by the seal bars and the timing for opening the second on-off valve to enable the pipe nozzle to start vacuum suction which precedes the timing for cross sealing, in a direction that will enlarge the time difference between the first and second mentioned timings.

7. A packaging apparatus as set forth in claim 1, further comprising:

means for detecting feed intervals with respect to articles to be packaged on the transport path for the articles thereby to obtain pitch data corresponding to the feed intervals;

means for stopping the film and seal bars when an unusual spread occurs with respect to the pitch data and until the unusual spread is eliminated;

a second on-off valve of the normally open type disposed downstream of the first on-off valve on the connecting pipe along the direction of vacuum suction by the pipe nozzle;

means for closing the second on-off valve while movement of the film and seal bars is at a stop; and means for controlling the movement of the film and seal bars when they resume movement after having been at a halt, in such a way that they initiate movement at a gentle speed and later go into movement at an accelerated speed.

8. An apparatus for packaging articles in deaerated condition which includes an elongate pipe nozzle disposed along a path for transport of the articles to be packaged, means for tubulating a belt-like film moving in the same direction as the articles in such a way as to sequentially enclose the articles and the pipe nozzle, the pipe nozzle being connected to a source of vacuum via a connecting pipe, and seal bars for cross sealing the tubulated film cyclically by pressing the film from opposite sides and between adjacent articles at a location adjacent one end of the pipe nozzle while the air in the tubulated film is sucked by the pipe nozzle, said apparatus comprising:

means for keeping the interior of the film in a negative pressure condition through sucking action of the pipe nozzle so as not to cause any greater friction than necessary between the pipe nozzle and the film, when the articles being packaged are transported in conjunction with the movement of the film;

means for causing the pipe nozzle to produce an impulsive suction force in cyclically timed relation to cross sealing action of the seal bars on the film but immediately prior to the film being pressed by the seal bars from opposite sides, thereby enabling the air in the interior of the film to be momentarily discharged, said connecting pipe, which connects the pipe nozzles to the vacuum source, having a cross-sectional passage area comparable to or larger than that of the pipe nozzle;

a first on-off valve of the normally closed type provided midway on the connecting pipe;

a bypass tube bypassing the first on-off valve and having a cross-sectional passage area smaller than that of the pipe nozzle; and control means for impulsively opening the on-off valve in cyclically timed relation to the cross sealing action of the seal bars but immediately prior to the film being pressed by the seal bars from opposite sides.

* * * * *